US009236019B2

(12) United States Patent
Ting et al.

(10) Patent No.: US 9,236,019 B2
(45) Date of Patent: Jan. 12, 2016

(54) DISPLAY DEVICE AND DRIVING METHOD THEREOF

(71) Applicant: AU OPTRONICS CORP., Hsinchu (TW)

(72) Inventors: Yu-Hsin Ting, Hsin-Chu (TW); Wei-Chun Hsu, Hsin-Chu (TW); Chung-Lin Fu, Hsin-Chu (TW); Chung-Hung Chen, Hsin-Chu (TW); Chin-Tang Chuang, Hsin-Chu (TW)

(73) Assignee: AU OPTRONICS CORP., Hsinchu (TW)

( * ) Notice: Subject to any disclaimer, the term of this patent is extended or adjusted under 35 U.S.C. 154(b) by 0 days.

(21) Appl. No.: 14/300,776

(22) Filed: Jun. 10, 2014

(65) Prior Publication Data

US 2015/0123958 A1 May 7, 2015

(30) Foreign Application Priority Data

Nov. 1, 2013 (TW) ..... 102139788 A

(51) Int. Cl.
*G09G 3/36* (2006.01)

(52) U.S. Cl.
CPC ..... *G09G 3/3648* (2013.01); *G09G 2310/0251* (2013.01); *G09G 2310/0297* (2013.01)

(58) Field of Classification Search
CPC ..... G06F 3/038; G09G 5/00; G09G 3/36; G09G 3/34
USPC ..... 345/89, 90, 92, 94, 98, 99, 100, 208
See application file for complete search history.

(56) References Cited

U.S. PATENT DOCUMENTS

| | | | | |
|---|---|---|---|---|
| 7,683,870 | B2 * | 3/2010 | Kang et al. | 345/89 |
| 7,812,805 | B2 * | 10/2010 | Miura | 345/96 |
| 8,305,324 | B2 | 11/2012 | Kim et al. | |
| 8,344,981 | B2 | 1/2013 | Morita | |
| 2005/0212742 | A1 * | 9/2005 | Nishitani et al. | 345/92 |
| 2006/0152535 | A1 * | 7/2006 | Huang et al. | 345/690 |
| 2009/0303166 | A1 | 12/2009 | Tsubata | |
| 2012/0113068 | A1 * | 5/2012 | Chen et al. | 345/204 |

FOREIGN PATENT DOCUMENTS

| | | |
|---|---|---|
| CN | 101467200 | 6/2009 |
| TW | I294605 | 3/2008 |
| TW | I300211 | 8/2008 |

* cited by examiner

*Primary Examiner* — Pegeman Karimi
(74) *Attorney, Agent, or Firm* — WPAT, PC; Justin King; Douglas Hosack

(57) ABSTRACT

A display device includes multiple pixels, a gate driver and a data driver. Each pixel includes a transistor and a pixel capacitor electrically coupled to the transistor. The gate driver is configured to turn on the transistor of a first pixel for one time during a first turn-on period of multiple turn-on cycles of a frame cycle of a frame displayed by the display device. The data driver is configured to charge the pixel capacitor of the first pixel via the transistor of the first pixel to a first over-charge voltage and a data voltage during an over-charge period and a recovery period of the first turn-on period. The first over-charge voltage is different from the data voltage. A method for driving the display device is also provided.

30 Claims, 12 Drawing Sheets

DISPLAY DEVICE AND DRIVING METHOD THEREOF

RELATED APPLICATIONS

This application claims priority to Taiwan Application Serial Number 102139788, filed Nov. 1, 2013, which is herein incorporated by reference.

BACKGROUND

1. Field of Invention

The present invention relates to a device for controlling light and a method for driving such a device. More particularly, the present invention relates to a display device and a method for driving the same.

2. Description of Related Art

Liquid crystal displays are often used as display devices due to their ability to render high-quality images using relatively little electricity. A liquid crystal display apparatus comprises a liquid crystal display panel. With the improvements in the resolution of the liquid crystal display panel, the number of gate lines has also increased correspondingly so as to enable control of the corresponding pixels in the liquid crystal display panel.

However, because of the increased number of gate lines, the conducting time of each gate line available for charging the corresponding pixel is shortened; further, the increased load of the active area of the liquid crystal display panel causes incomplete charging of the pixels, thereby resulting in abnormal display by the display device.

In view of the foregoing, problems and disadvantages are present in the existing products that await further improvement. However, those skilled in the art have been unable to find a solution.

SUMMARY

The following summary presents a simplified summary of the disclosure in order to provide a basic understanding to the reader. This summary is not an extensive overview of the disclosure and it does not identify key/critical elements of the present invention or delineate the scope of the present invention.

One aspect of the present invention is directed to a display device which comprises a plurality of pixels, a gate driver and a data driver. Each of the plurality of pixels comprises a transistor and a pixel capacitor, in which the transistor is electrically coupled to the pixel capacitor. The gate driver is configured to turn on the transistor of a first pixel of the plurality of pixels for one time during a first turn-on period of a plurality of turn-on cycles of a frame cycle of a frame displayed by the display device. The gate driver is configured to turn on the transistor of a second pixel of the plurality of pixels during a second turn-on period of the frame cycle. The data driver is configured to charge the pixel capacitor of the first pixel to a first over-charge voltage via the transistor of the first pixel during an over-charge period of the first turn-on period, and charge the pixel capacitor of the first pixel to a data voltage via the transistor of the first pixel during a recovery period of the first turn-on period. Moreover, the data driver is configured to charge the pixel capacitor of the second pixel to a second over-charge voltage via the transistor of the second pixel during an over-charge period of the second turn-on period, and charge the pixel capacitor of the second pixel to a data voltage via the transistor of the second pixel during a recovery period of the second turn-on period, wherein one of the first over-charge voltage and the second over-charge voltage is greater than the data voltage, and the other of the first over-charge voltage and the second over-charge voltage is less than the data voltage.

Another aspect of the present invention is directed to a method for driving a display device which comprises a plurality of pixels, in which each of the plurality of pixels comprises a transistor and a pixel capacitor, and the transistor is electrically coupled to the pixel capacitor. The driving method comprises turning on the transistor of a first pixel of the plurality of pixels for one time during a first turn-on period of a plurality of turn-on cycles of a frame cycle of a frame displayed by the display device; charging the pixel capacitor of the first pixel to a first over-charge voltage via the transistor of the first pixel during an over-charge period of the first turn-on period; charging the pixel capacitor of the first pixel to a data voltage via the transistor of the first pixel during a recovery period of the first turn-on period; turning on the transistor of a second pixel of the plurality of pixels during a second turn-on period of the frame cycle; charging the pixel capacitor of the second pixel to a second over-charge voltage via the transistor of the second pixel during an over-charge period of the second turn-on period; and charging the pixel capacitor of the second pixel to the data voltage via the transistor of the second pixel during a recovery period of the second turn-on period, wherein one of the first over-charge voltage and the second over-charge voltage is greater than the data voltage, and the other of the first over-charge voltage and the second over-charge voltage is less than the data voltage.

In view of the foregoing, embodiments of the present disclosure provide a display device and a method for driving the same to overcome the problem of abnormal display resulting from the incomplete charging of pixels due to the increased number of gate lines and increased loading of the active area of the liquid crystal display panel.

These and other features, aspects, and advantages of the present invention, as well as the technical means and embodiments employed by the present invention, will become better understood with reference to the following description in connection with the accompanying drawings and appended claims.

BRIEF DESCRIPTION OF THE DRAWINGS

The invention can be more fully understood by reading the following detailed description of the embodiment, with reference made to the accompanying drawings as follows.

Figure 1:
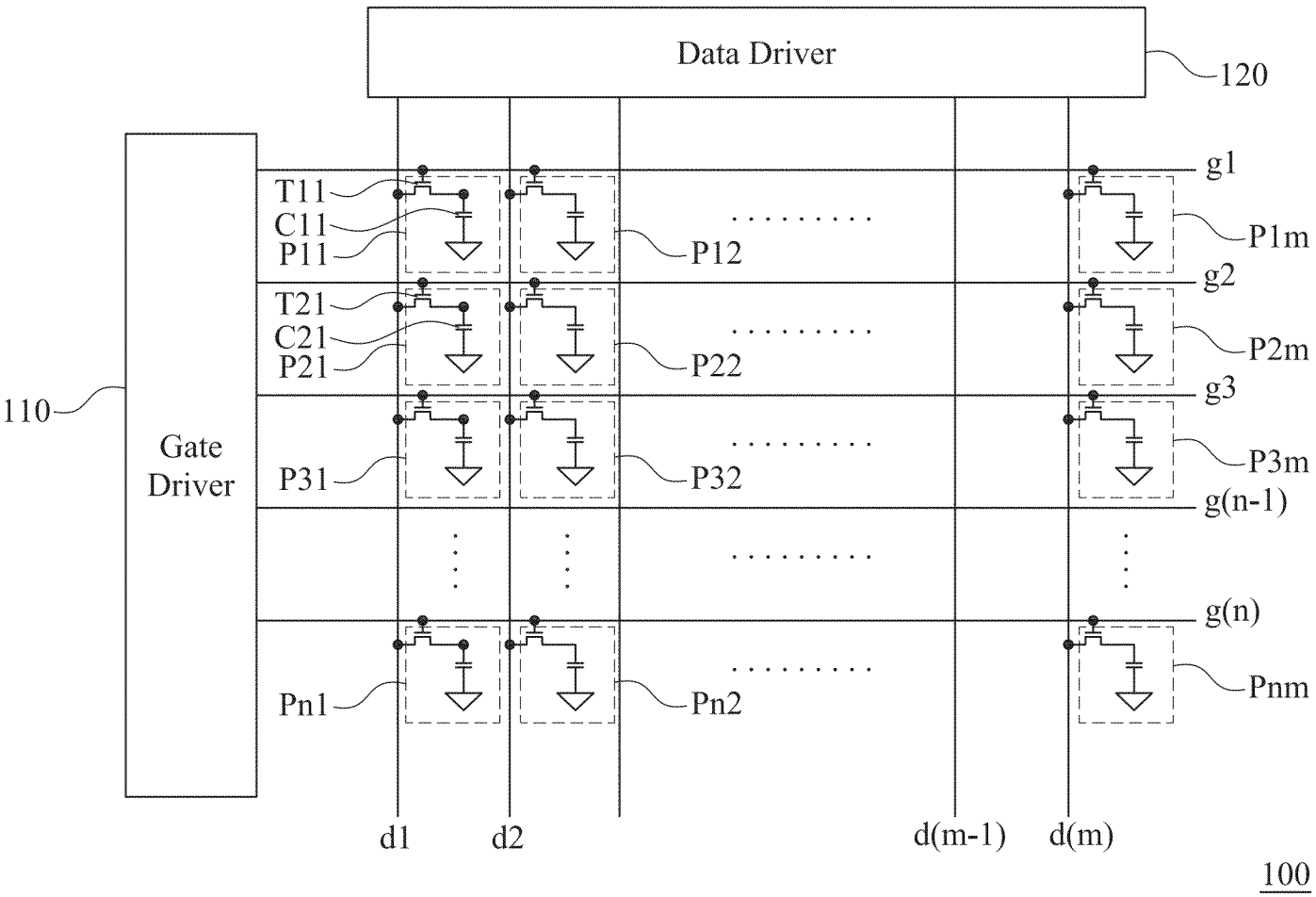
FIG. 1 is a schematic diagram of a display device according to embodiments of the present invention.

In accordance with common practice, the various described features/elements are not drawn to scale but instead are drawn to best illustrate specific features/elements relevant to the present invention. Also, wherever possible, like or the same reference numerals are used in the drawings and the description to refer to the same or like parts.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

Unless otherwise defined herein, scientific and technical terminologies employed in the present disclosure shall have the meanings that are commonly understood and used by one of ordinary skill in the art. Unless otherwise required by context, it will be understood that singular terms shall include plural forms of the same and plural terms shall include the singular Further, the term "couple" or "connect," as used herein, refers to the direct or indirect physical or electrical contact between or among two or more components, or the mutual operation or action of two or more components.

To address the problems faced by the prior art, the present invention provides a display device and a method for driving the same The display device is schematically illustrated in FIG. 1, and the method for driving the same is described hereinbelow. As illustrated, the display device 100 comprises a plurality of pixels P11-Pnm, a gate driver 110 and a data driver 120. Each of the plurality of pixels P11-Pnm comprises a transistor and a pixel capacitor.

Structurally, the transistor of each of the plurality of pixels P11~Pnm is electrically coupled to the pixel capacitor thereof. The gate driver 110 is electrically coupled to the corresponding pixels via gate lines g1~g(n). The data driver 120 is electrically coupled to the corresponding pixels via data lines d1~d(m).

Figure 2:
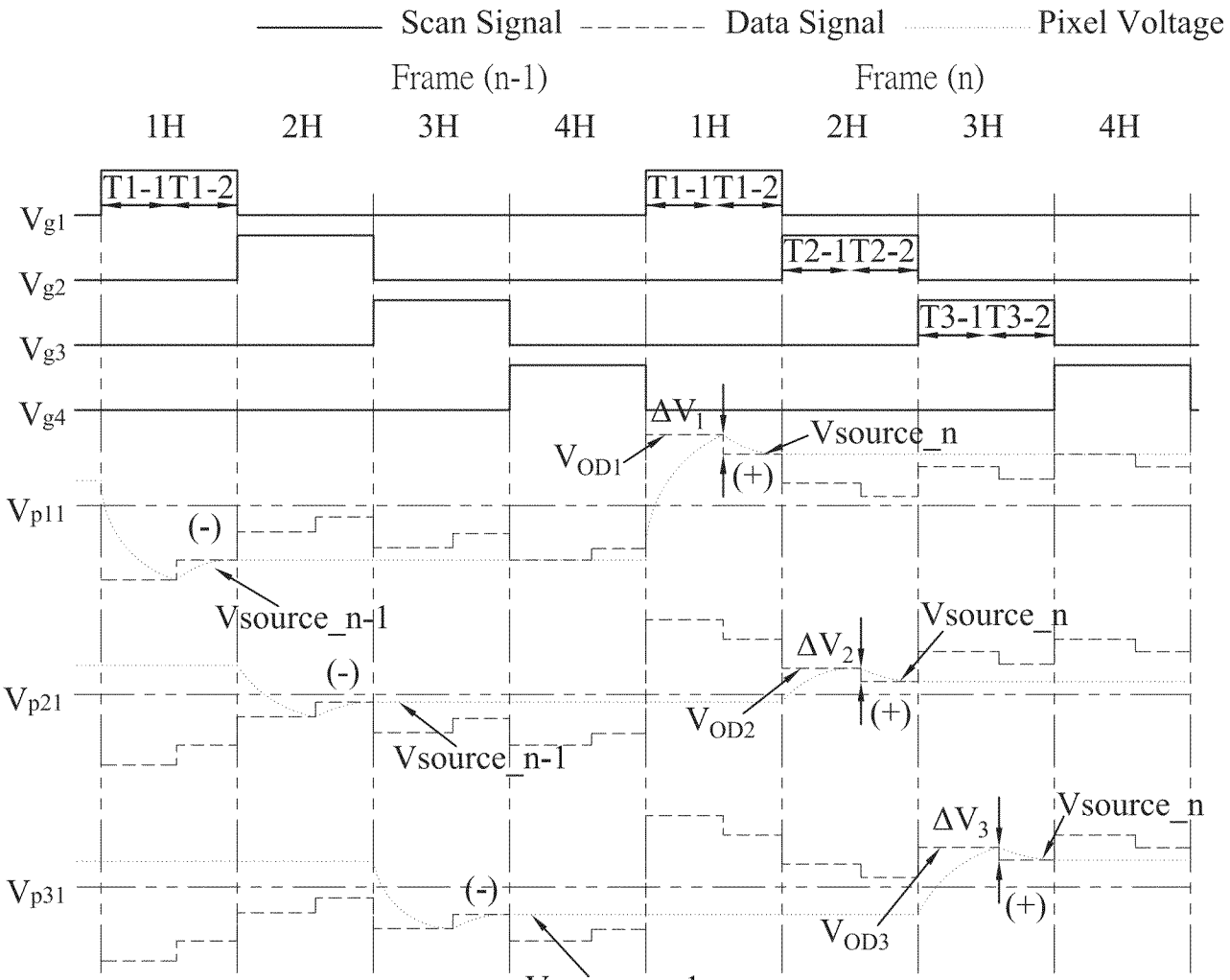
FIG. 2 is a schematic diagram illustrating a driving waveform according to embodiments of the present invention.

To facilitate the understanding of the electric operation of the present disclosure, reference is made to both FIG. 1 and FIG. 2, in which FIG. 2 is a schematic diagram illustrating a driving waveform according to one embodiment of the present invention. Specifically, FIG. 2 illustrates a frame cycle Frame(n) of a frame currently displayed by the display device 100 and a previous frame cycle Frame(n−1). Here, the frame cycle Frame(n) of the frame displayed by the display device 100 comprises a plurality of turn-on periods 1H~4H; however, the present disclosure is not limited thereto, and persons having ordinary skill in the art may flexibly arrange the number of the turn-on periods depending on actual need without departing from the spirit of the present invention.

As illustrated, the gate driver 110 turns on the transistor T11 of the pixel P11 for one time during the first turn-on period 1H. Thereafter, the data driver 120 charges the pixel capacitor C11 of the pixel P11 to a first over-charge voltage $V_{OD1}$ via the transistor T11 of the pixel P11 during the first turn-on period 1H, and charges the pixel capacitor C11 of the pixel P11 to a data voltage Vsource_n via the transistor T11 of the pixel P11 during the recovery period T1-2 of the first turn-on period 1H. Here, the first over-charge voltage $V_{OD1}$ may be greater than the data voltage Vsource_n; however, in other embodiments, the first over-charge voltage $V_{OD1}$ may also be less than the data voltage Vsource_n.

In summary, the pixel capacitor C11 of the pixel P11 should be charged to the data voltage Vsource_n; however, since the resolution of the liquid crystal panel of the display device 100 is increased, the time available for each gate line to be charged is shortened. This may result in the incomplete charging of the pixel capacitor C11 of the pixel P11. However, the present invention solves this problem. According to the present invention, when the gate driver 110 of the display device 100 turns on the transistor T11 of the pixel P11, the data driver 120 provides to the pixel capacitor C11 of the pixel P11 a voltage greater or less than the data voltage Vsource_n during the over-charge period, such that the pixel capacitor C11 of the pixel P11 can be rapidly charged to a predetermined data voltage Vsource_n; next, the data driver 120 allows the voltage of the pixel capacitor C11 of the pixel P11 to return to the data voltage Vsource_n during the recovery period.

In this way, the display device 100 according to the present disclosure overcomes the problem of abnormal display resulting from the incomplete charging of pixels due to the increased number of gate lines and increased loading of the active area of the liquid crystal display panel.

It should be noted that the arrangement of the internal components of the display device 100 according to the present invention is not limited to that illustrated in FIG. 1. FIG. 1 is only one embodiment for exemplifying the display device 100 according to the present invention. Moreover, while implementing the present invention, the display device 100 can be a liquid crystal display (LCD), a plasma display panel (PDP), etc., but is not limited to such display device configurations. Furthermore, the transistor of the pixel P11 can be a bipolar junction transistor (BJT), a metal oxide semiconductor field-effect transistor (MOSFET), an insulated gate bipolar transistor (IGBT), etc., bus is not limited to such transistor configurations.

Reference is made to FIG. 2 which schematically illustrates the driving waveform of the display device 100 according to the present invention operated in the column inversion mode. As illustrated during the recovery period T1-2 of the first turn-on period 1H of the previous frame cycle Frame(n−1), the previous data voltage Vsource_n−1 provided to the pixel P11 has a negative polarity; whereas during the recovery period T1-2 of the first turn-on period 1H of the frame cycle Frame(n), the data voltage Vsource_n provided to the pixel P11 has a positive polarity. In this case, since the polarity of the pixel P11 is converted from negative to positive polarity, the data driver 120 determines that the first over-charge voltage $V_{OD1}$ which is provided to the pixel capacitor C11 of the pixel P11 is greater than the data voltage Vsource_n, according to the status of the previous data voltage Vsource_n−1 and the data voltage Vsource_n. The driving method for other pixels is similar to that of the pixel P11, and hence a detailed description thereof is omitted herein for the sake of brevity.

In one embodiment, since the parameters of the internal components of the display device 100 may vary, persons having ordinary skill in the art may flexibly adjust the time durations of the over-charge period T1-1 and the recovery period T1-2 of the first turn-on period 1H without departing from the spirit of the present invention. Moreover, the time durations of the over-charge period T2-1 and the recovery period T2-2 of the second turn-on period 2H and the time durations of the over-charge period T3-1 and the recovery period T3-2 the third turn-on period 3H can also be adjusted selectively.

Figure 3:
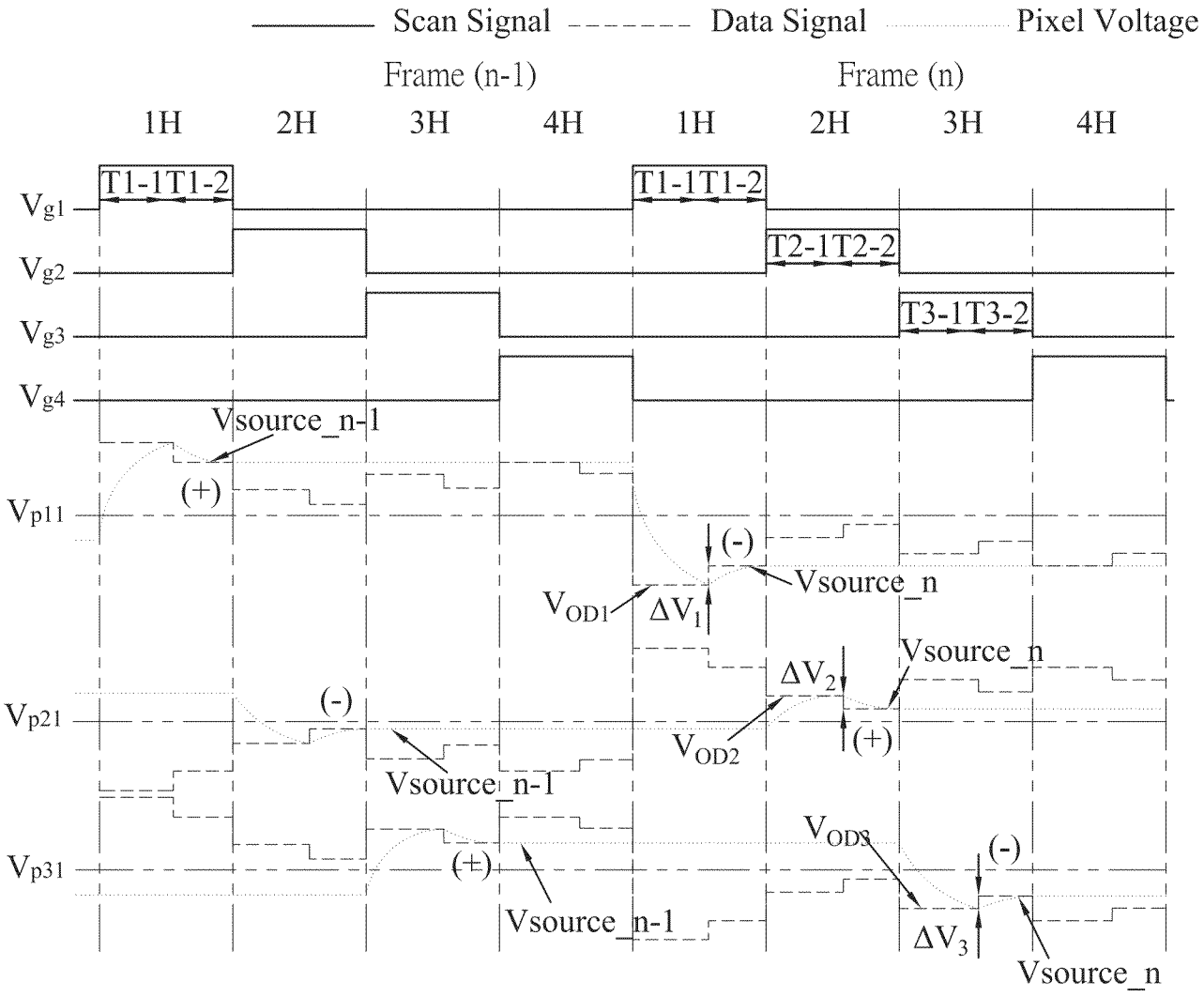
FIG. 3 is a schematic diagram illustrating a driving waveform according to embodiments of the present invention.

Reference is made to FIG. 3 which is a schematic diagram of the driving waveform of the display device 100 according to the present invention operated in a row inversion mode. Here, the electrical operation of the display device 100 according to the present invention is similar to that illustrated in FIG. 2, except that in FIG. 3, the first over-charge voltage $V_{OD1}$ is less than the data voltage Vsource_n. This is due to the fact that during the previous frame cycle Frame(n−1), the previous data voltage Vsource_n−1 provided to the pixel P11 has a positive polarity, whereas during the frame cycle Frame (n), the data voltage Vsource_n provided to the pixel P11 has a negative polarity. In this case, since the polarity of the pixel P11 is converted from positive to negative, data driver 120 determines that the first over-charge voltage $V_{OD1}$ which is provided to the pixel capacitor C11 of the pixel P11 is less than the data voltage Vsource_n, so as to facilitate the rapid conversion of the voltage of the pixel P11 into a negative voltage.

With continued reference to FIG. 3, during the second turn-on period 2H of the frame cycle Frame(n), the gate driver 110 turns on the transistor T21 of the pixel P21 of the plurality of pixels during the over-charge period T2-1 of the second turn-on period 2H, the data driver 120 charges the pixel capacitor C21 of the pixel P21 to a second over-charge voltage $V_{OD2}$ via the transistor T21 of the pixel P21, and during the recovery period T2-2 of the second turn-on period 2H, the data driver 120 charges the pixel capacitor C21 of the pixel P21 to the data voltage Vsource_n via the transistor T21 of the pixel P21.

As can be seen in FIG. 3, the second over-charge voltage $V_{OD2}$ is greater than the data voltage Vsource_n. This is due to the fact that during the previous frame cycle Frame(n−1), the previous data voltage Vsource_n−1 provided to the pixel P21 has a negative polarity, whereas during the frame cycle Frame(n), the data voltage Vsource_n provided to the pixel P21 has a positive polarity. In this case, since the polarity of the pixel P21 is converted from negative to positive, the data driver 120 determines that the second over-charge voltage $V_{OD2}$ which is provided to the pixel capacitor C21 of the pixel P21 is greater than the data voltage Vsource_n, so as to facilitate the rapid conversion of the voltage of the pixel P11 into a positive voltage. Moreover. the driving method for pixel P31 is similar to that of the pixel P11, and hence a detailed description thereof is omitted herein for the sake of brevity.

Referring to both FIG. 2 and FIG. 3, the first over-charge voltage $V_{OD1}$ and the data voltage Vsource_n have a first difference ΔV1 therebetween, the second over-charge voltage $V_{OD2}$ and the data voltage Vsource_n have a second difference ΔV2 therebetween, while the third over-charge voltage $V_{OD3}$ and the data voltage Vsource_n has a third difference ΔV3 therebetween. Here, all, some or none of the first difference ΔV1, the second difference ΔV2 and the third difference ΔV3 can be the same, and they can be selectively arranged depending on actual need. It should be noted that the first, the second or the third difference ΔV1~ΔV3 is in direct proportion to the time duration of the recovery period of the corresponding turn-on period. This is due to the fact that when the over-charge voltage provided to the pixel during the over-charge period is higher or lower than the data voltage Vsource_n to a greater extent, the pixel requires a longer recovery period to return to the data voltage Vsource_n. Moreover, all, some or none of the recovery period T1-2 of the first turn-on period 1H, the recovery period T2-2 of the second turn-on period 2H, and the recovery period T3-2 of the third turn-on period 3H can be the same, and they can be selectively arranged depending on actual need.

In one optional embodiment, the display device 100 further comprises a comparator (not shown) which is configured to compare the data voltage Vsource_n of the frame cycle Frame (n) and the previous data voltage Vsource_n−1 of the previous frame cycle Frame(n−1). When the data voltage Vsource_n is greater than the previous data voltage Vsource_n−1, it is determined that the first over-charge voltage $V_{OD1}$ is greater than the data voltage Vsource_n, and when the data voltage Vsource_n is less than the previous data voltage Vsource_n−1, it is determined that the first over-charge voltage $V_{OD1}$ is less than the data voltage Vsource_n. Moreover, the logic for determining the second over-charge voltage $V_{OD2}$ and the third over-charge voltage $V_{OD3}$ is similar to that for determining the first over-charge voltage $V_{OD1}$, and hence a detailed description thereof is omitted herein for the sake of brevity.

Figure 4:
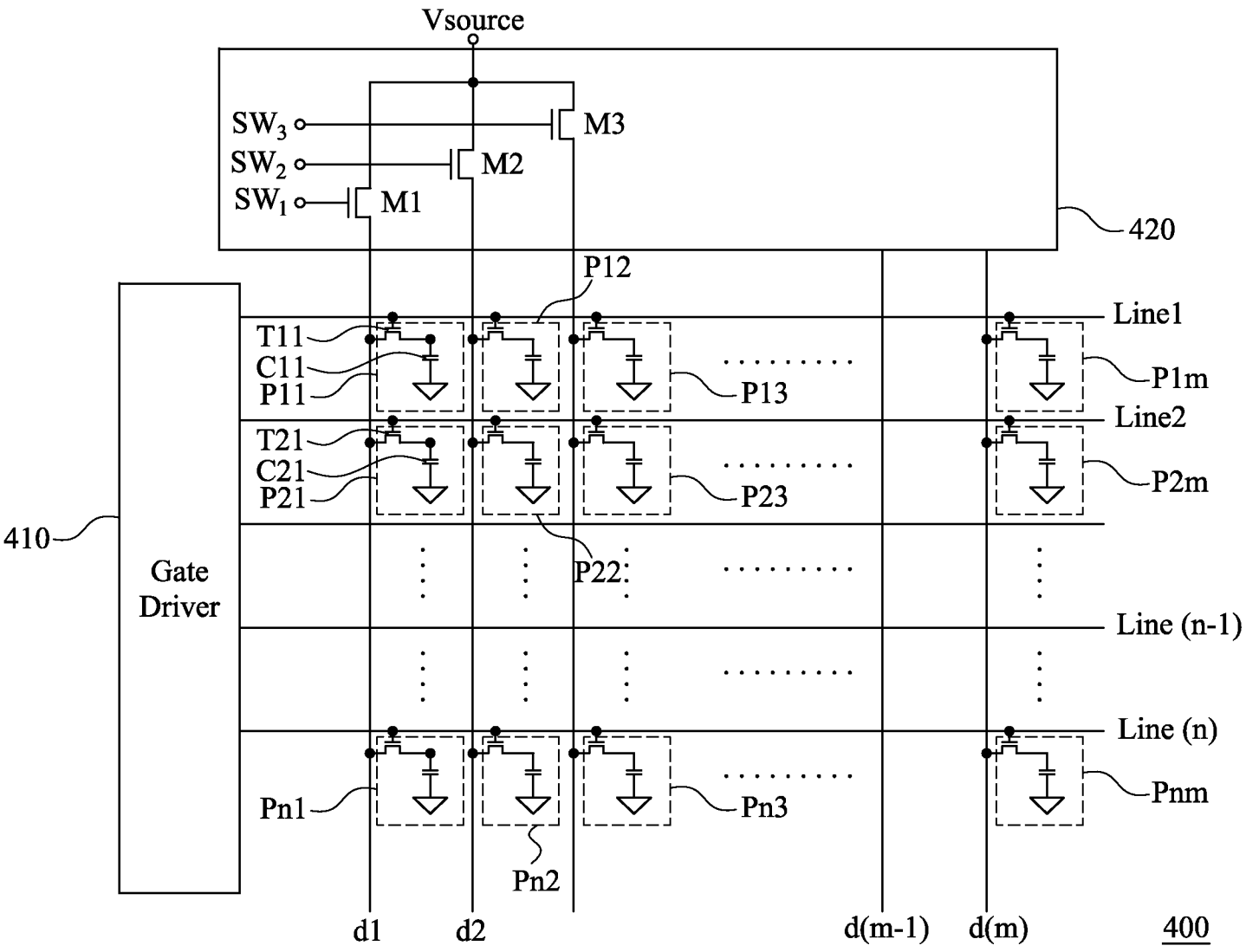
FIG. 4 is a schematic diagram of a display device according to embodiments of the present invention.

FIG. 4 is a schematic diagram illustrating a display device according to embodiments of the present invention. As illustrated, the display device 400 is similar to the display device 100 of FIG. 1, except that the data driver 420 of the display device 400 further comprises a first switch M1, a second switch M2 and a third switch M3, wherein the first switch M1 is configured to receive a first switch signal $SW_1$, the second switch M2 is configured to receive a second switch signal $SW_2$, and the third switch M3 is configured to receive a third switch signal $SW_3$. Moreover, the display device 400 further comprises a first scan line Line1 and a second scan line Line2, and the first scan line Line1 and the second scan line Line2 are arranged sequentially. The first switch M1 is electrically coupled to pixels P11 and P21, the second switch M2 is electrically coupled to pixels P12 and P22, the third switch M3 is electrically coupled to pixels P13 and P23, the first scan line Line1 is electrically coupled to pixels P11, P12 and P13, and the second scan line Line2 is electrically coupled to pixels P21, P22 and P23.

Figure 5:
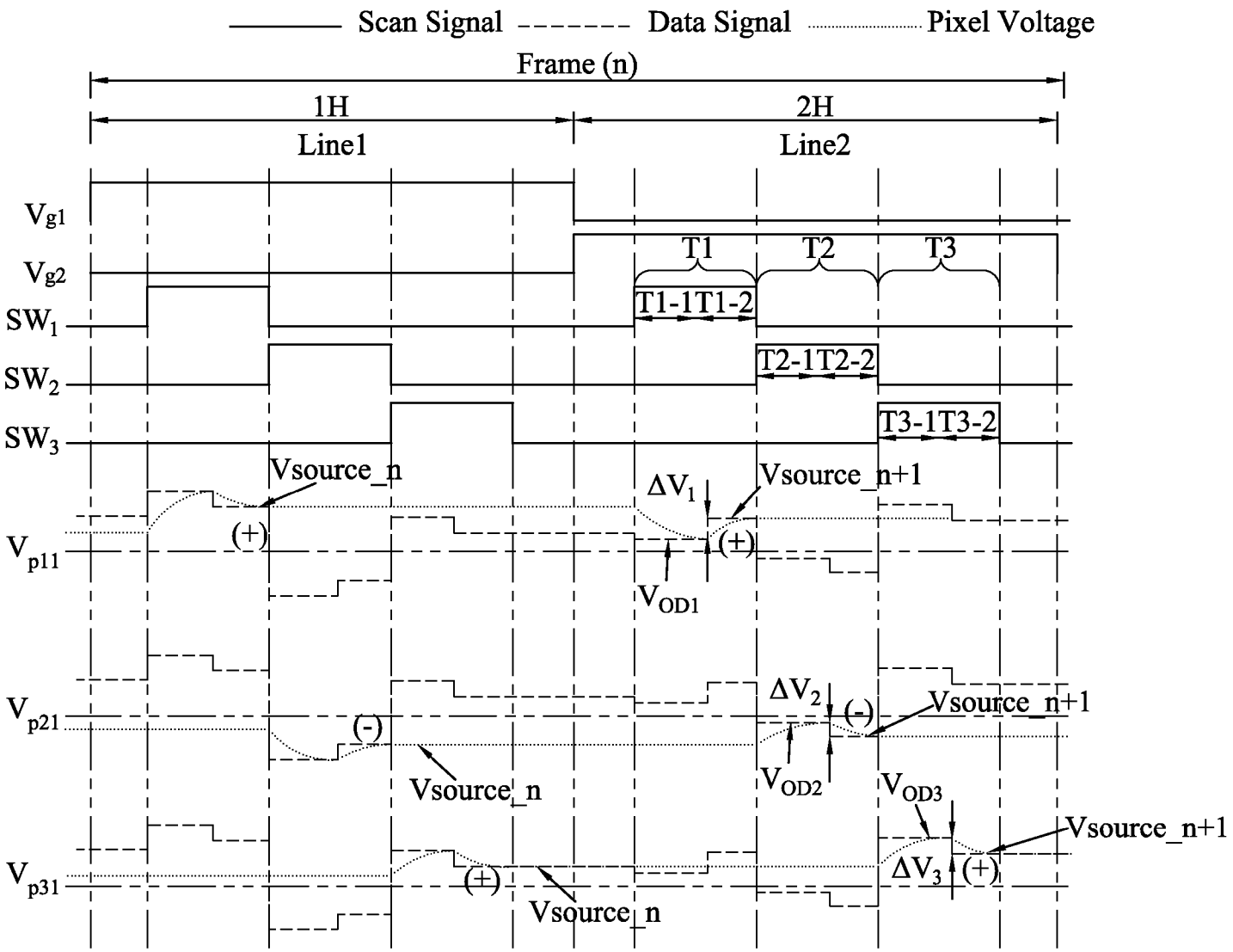
FIG. 5 is a schematic diagram illustrating a driving waveform according to embodiments of the present invention.

To facilitate the understanding of the electric operation of the present disclosure, reference is made to both FIG. 4 and FIG. 5, in which FIG. 5 is a schematic diagram illustrating a driving waveform according to one embodiment of the present invention. As illustrated, the gate driver 110 turns on the transistor T21 of the pixel P21 via the second scan line Line2 during the second turn-on period 2H of the display device 100. The data driver 120 charges the pixel capacitor C21 of the pixel P21 to a first over-charge voltage $V_{OD1}$ via the transistor T21 of the pixel P21 during the over-charge period T1-1 of the first control period T of the second turn-on period 2H, and charges the pixel capacitor C21 of the pixel P21 to another data voltage Vsource_n+1 via the transistor T21 of the pixel P21 during the recovery period T1-2 of the first control period T1 of the second turn-on period 2H. Here, the first over-charge voltage $V_{OD1}$ may be less than said another data voltage Vsource_n+1; however in other embodiments, the first over-charge voltage $V_{OD1}$ may also be greater than the another data voltage Vsource_n+1.

Moreover, the gate driver 110 turns on the first switch M1 during the first control period T1 of the second turn-on period 2H of the frame cycle Frame(n), turns on the second switch M2 during the second control period T2 of the second turn-on period 2H of the frame cycle Frame(n), and turns on the third switch M3 during the third control period T3 of the second turn-on period 2H of the frame cycle Frame(n). Thereafter, the data driver 120 charges the pixel capacitor C21 of the pixel P21 to the first over-charge voltage $V_{OD1}$ via the first switch M1 during the over-charge period T1-1 of the first control period T of the second turn-on period 2H, charges the pixel capacitor C22 of the pixel P22 to the second over-charge voltage $V_{OD2}$ via the second switch M2 during the over-charge period T2-1 of the second control period T2 of the second turn-on period 2H, and charges the pixel capacitor C23 of the pixel P23 to the third over-charge voltage $V_{OD3}$ via the third switch M3 during the over-charge period T3-1 of the third control period T3 of the second turn-on period 2H. As illustrated, the first over-charge voltage $V_{OD1}$ is less than the another data voltage Vsource_n+1, the second over-charge voltage $V_{OD2}$ is greater than the data voltage Vsource_n+1, and the third over-charge voltage $V_{OD2}$ is greater than the data voltage Vsource_n+1. However, the present invention is not limited thereto, and persons having ordinary skill in the art can selectively arrange the over-charge voltage depending on actual needs.

In another embodiment, since the parameters of the internal components of the display device 400 may vary, persons having ordinary skill in the art may flexibly adjust the time durations of the over-charge period T1-1 and the recovery period T1-2 of the first turn-on period 1H without departing from the spirit of the present invention. Moreover, the time durations of the over-charge period T2-1 and the recovery period T2-2 of the second turn-on period 2H and the time durations of the over-charge period T3-1 and the recovery period T3-2 of the third turn-on period 3H can also be adjusted selectively depending on actual needs.

Reference is now made to FIG. 5 which schematically illustrates the driving waveform of the display device 100 according to the present invention operated in the column inversion mode. In this embodiment, the value of the first over-charge voltage $V_{OD1}$ of the pixel P21 is determined according to the data voltage Vsource_n of the pixel P11.

Specifically, the display device 100 further comprises a comparator (not shown) which is configured to compare the another data voltage Vsource_n+1 and the data voltage Vsource_n. When the another data voltage Vsource_n+1 is greater than the data voltage Vsource_n, it is determined that the first over-charge voltage $V_{OD1}$ is greater than the another data voltage Vsource_n+1. On the other hand, when the another data voltage Vsource_n+1 is less than the data voltage Vsource_n, it is determined that the first over-charge voltage $V_{OD1}$ is less than the another data voltage Vsource_n+1. Moreover, the logic for determining the second over-charge voltage $V_{OD2}$ and the third over-charge voltage $V_{OD3}$ is similar to that for determining the first over-charge voltage $V_{OD1}$, and hence a detailed description thereof is omitted herein for the sake of brevity.

Figure 6:
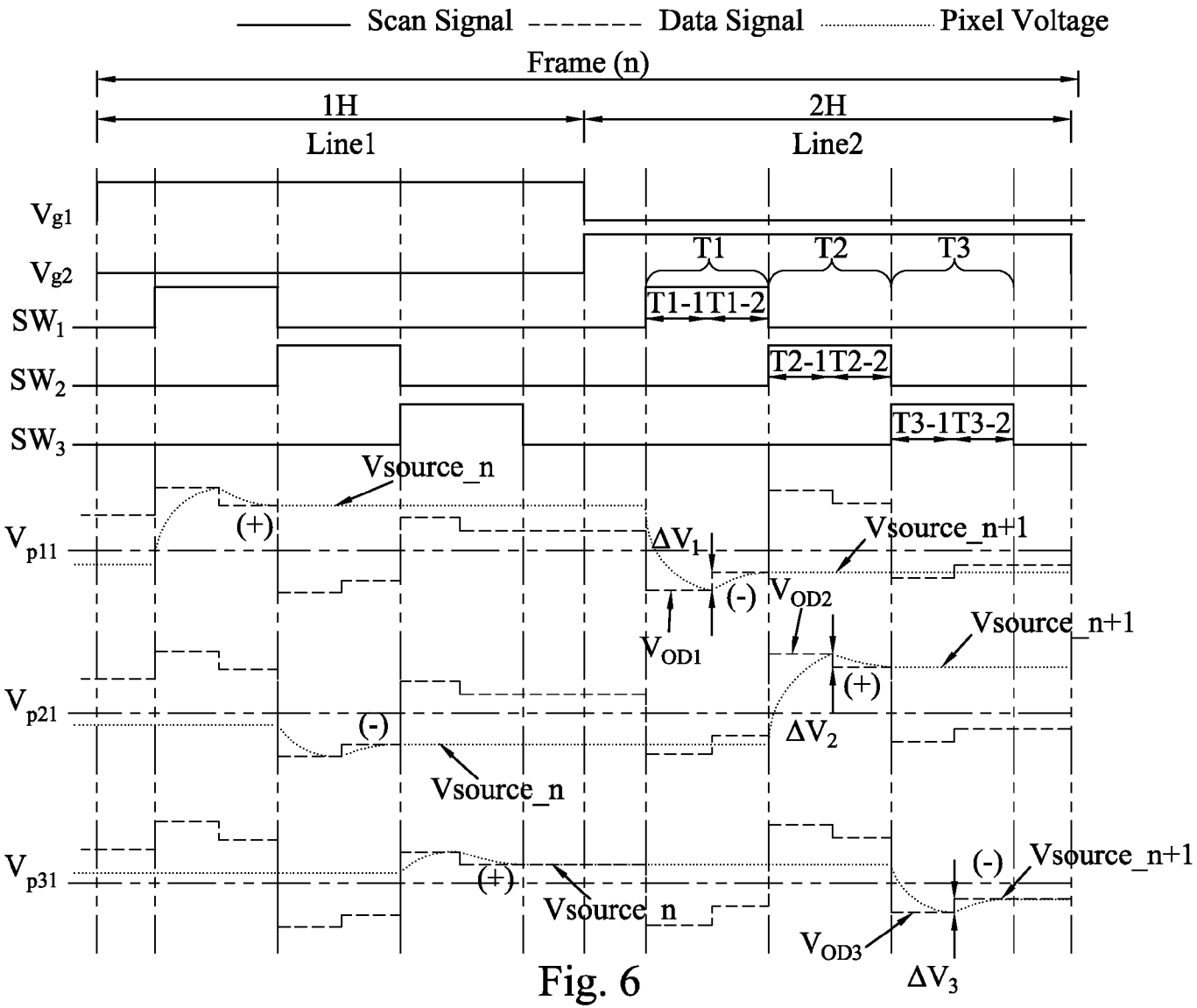
FIG. 6 is a schematic diagram illustrating a driving waveform according to embodiments of the present invention.

Reference is now made to FIG. 6 which is a schematic diagram of the driving waveform of the display device 100 according to the present invention operated in a dot inversion mode. To facilitate the understanding of the operation of the present disclosure, reference is made to both FIG. 4 and FIG. 6. As illustrated, the first over-charge voltage $V_{OD1}$ is determined according to the data voltage Vsource_n provided to the pixel P11 and the data voltage Vsource_n+1 provided to the pixel P21. Here, since the data voltage Vsource_n provided to the pixel P11 is positive, while the data voltage Vsource_n+1 provided to the pixel P21 is negative, the first over-charge voltage $V_{OD1}$ is less than the data voltage Vsource_n+1. Moreover, since the data voltage Vsource_n provided to the pixel P12 is negative, while the data voltage Vsource_n+1 provided to the pixel P22 is positive, the second over-charge voltage $V_{OD2}$ is greater than the data voltage Vsource_n+1. Further, the logic for determining the third over-charge voltage $V_{OD3}$ is similar to that for determining the first over-charge voltage $V_{OD1}$, and hence a detailed description thereof is omitted herein for the sake of brevity.

Referring to both FIG. 5 and FIG. 6, the first over-charge voltage $V_{OD1}$ and the another data voltage Vsource_n+1 have a first difference ΔV1 therebetween, the second over-charge voltage $V_{OD2}$ and the another data voltage Vsource_n+1 have a second difference ΔV2 therebetween, and the third over-charge voltage $V_{OD3}$ and the another data voltage Vsource_n+1 have a third difference ΔV3 therebetween. Here, all, some or none of the first difference ΔV1, the second difference ΔV2 and the third difference ΔV3 can be the same, and can be selectively determined depending on actual needs. It should be noted that the first, the second or the third difference ΔV1~ΔV3 is in direct proportion to the time duration of the recovery period of the corresponding control period. This is due to the fact that when the over-charge voltage provided to the pixel during the over-charge period is higher or lower than the another data voltage Vsource_n+1 to a greater extent, the pixel requires a longer recovery period to return to the another data voltage Vsource_n+1. Moreover, all, some or none of the over-charge period T1-1 of the first control period T1, the over-charge period T2-1 of the second control period T2, and the over-charge period T3-1 of the third control period T3 can be the same, and can be selectively arranged depending on actual needs.

Figure 7:
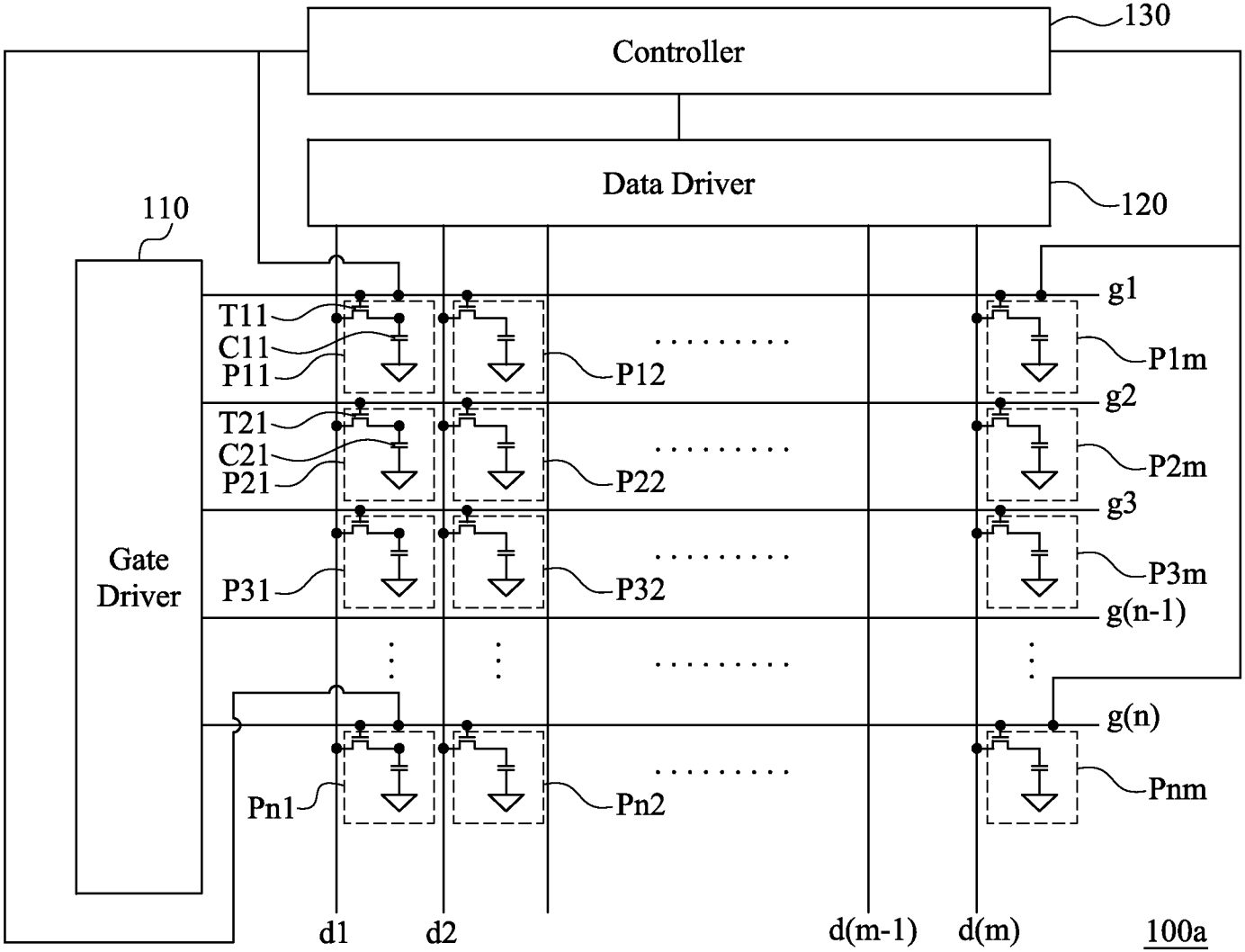
FIG. 7 is a schematic diagram of a display device according to embodiments of the present invention.

FIG. 7 is a schematic diagram illustrating a display device 100*a* according to embodiments of the present invention. Compared to the display device 100 of FIG. 1, the present display device 100*a* further comprises a controller 130, and the plurality of pixels P11~Pnm arranged into a pixel array having M columns and N rows. The controller 130 is coupled to each pixel of the pixel array, and configured to generate and output the control signal to a data driver 120 according to voltage signals of any two pixels of the pixel array, and allow the data driver 120 to adjust the first difference ΔV1, the second difference ΔV2 or the third difference ΔV3 shown in FIGS. 2, 3, 5 and 6 according to the control signal.

For example, the controller 130 can generate and output the control signal to the data driver 120 according to a first voltage signal of the pixel P11 at the first row and the first column of the pixel array and a second voltage signal of the pixel P1*m* at the first row and the $M^{th}$ column of the pixel array, and allow the data driver 120 to adjust the first difference ΔV1, the second difference ΔV2 or the third difference ΔV3 according to the control signal. In another embodiment, the controller 130 can generate and output the control signal to the data driver according to a first voltage signal of the pixel P11 at the first row and the first column of the pixel array and a second voltage signal of the pixel Pnm at the $N^{th}$ row and $M^{th}$ column of the pixel array, and allow the data driver 120 to adjust the first difference ΔV1, the second difference ΔV2 or the third difference ΔV3 according to the control signal. However, the present invention is not limited to the above-mentioned embodiments which are presented for the purpose of exemplifying one implementation of the present invention.

Figure 8:
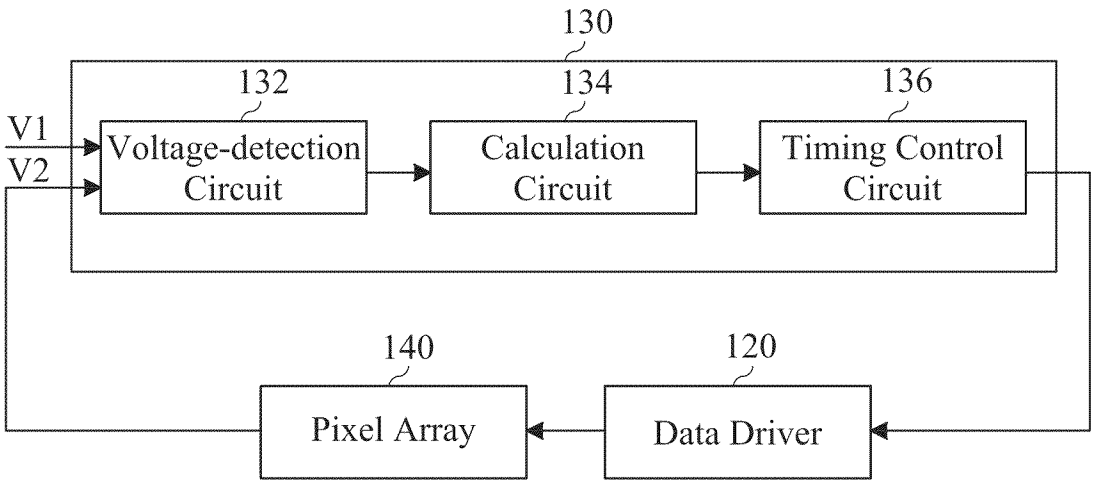
FIG. 8 is a schematic block diagram illustrating the display device of FIG. 7 according to embodiments of the present invention.

FIG. 8 is a block diagram schematically illustrating the display device 100*a* of FIG. 7 according to embodiments of the present invention. As illustrated in FIG. 8, the controller 130 comprises a voltage-detection circuit 132, a calculation circuit 134 and a timing control circuit 136. The voltage-detection circuit 132 is configured to detect the first voltage signal V1 and the second voltage signal V2. Said first voltage signal V1 can be a non-degraded voltage that does not pass the pixel array 140. For example, the first voltage signal V1 can be the voltage signal of the pixel P11 at the first row and the first column of the pixel array. Said second voltage signal V2 can be a degraded voltage that has passed the pixel array 140. For example, the second voltage signal V2 can be the voltage signal of the pixel P1*m* at the first row and the $M^{th}$ column or the voltage signal of the pixel Pnm at the $N^{th}$ row and the $M^{th}$ column. The calculation circuit 134 is configured to calculate a conducting time difference and a turn-off time difference according to the first voltage signal V1 and the second voltage signal V2, and the timing control circuit 136 is configured to generate and output the control signal to the data driver 120 according to the conducting time difference or the turn-off time difference, so that the data driver 120 adjusts the first difference ΔV1, the second difference ΔV2 or the third difference ΔV3 of the pixels of the pixel array 140 according to the control signal.

Figure 9:
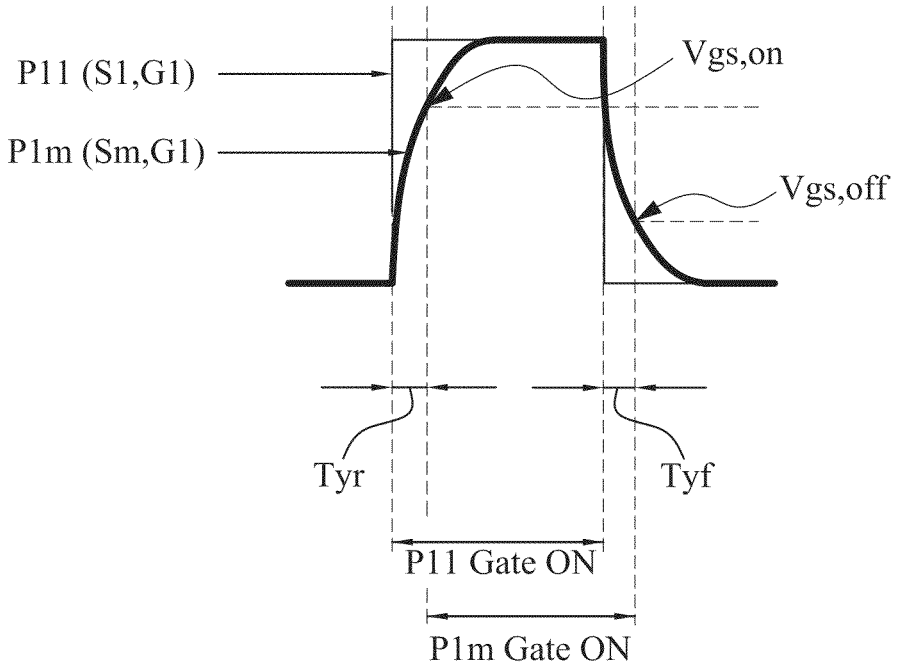
FIG. 9 is a schematic diagram illustrating a voltage signal of a pixel of a display device according to embodiments of the present invention.

Reference is now made to FIG. 9 which is a schematic diagram illustrating the voltage signal of the pixel of a display device 100*a* according to embodiments of the present invention. As illustrated, the voltage signal $V_{P11}$ is the voltage signal detected by the pixel P11, while the voltage signal $V_{P1m}$ is the voltage signal detected by pixel P1*m*. As can be seen in FIG. 9, the conducting time of the turn-on period of the pixel P11 (P11 Gate ON) is earlier than the conducting time of the turn-on period of the pixel P1*m* (P1*m* Gate ON), and there is a conducting time difference Tyr therebetween. Moreover, as illustrated in FIG. 9, the turn-off time of the turn-on period of the pixel P11 (P11 Gate ON) is earlier than the turn-off time of the turn-on period of the pixel P1*m* (P1*m* Gate ON), and there is a turn-off time difference Tyf therebetween. The calculation circuit 136 then calculates the conducting time difference Tyr and the turn-off time difference Tyf according to the voltage signal $V_{P11}$ and the voltage signal $V_{P1m}$. The timing control circuit 136 is configured to generate and output the control signal to the data driver 120 according to the conducting time difference Tyr or the turn-off time difference Tyf, so that the data driver 120 adjusts the first difference ΔV1, the second difference ΔV2 or the third difference ΔV3 of the pixel of the pixel array 140 according to the control signal.

For example, the difference ΔV is calculated according to the following equation:

$$\Delta V=(V_{Pix1}-V_{Pix2})+V_{ref} \qquad \text{Equation 1}$$

where $V_{pix1}$ and $V_{pix2}$ are the pixel voltages of any two pixels of the pixel array, and $V_{ref}$ is a reference voltage which can be obtained from a parameter table predetermined according to the display device.

Further, the pixel voltages $V_{pix1}$ and $V_{pix2}$ are calculated according to the following equations:

$$V_{pix1}=(AVDD-AVSS)e^{\frac{T_{gon}}{RC_p}}=\frac{1}{C_p}\int_{t=0}^{T_{gon}} I_{ds1}\,dt \qquad \text{Equation 2}$$

$$V_{pix2}=(AVDD-AVSS)e^{\frac{T_{gon}-T_{yd}}{RC_p}}=\frac{1}{C_p}\int_{t=0}^{T_{gon}-T_{yd}} I_{ds2}\,dt \qquad \text{Equation 3}$$

where AVDD is the highest pixel voltage, AVSS is the lowest pixel voltage, and $T_{gon}$ is the time duration between 90% of $V_{gs,on}$ of the pixel to 10% of $V_{gs,on}$ of the pixel. In another embodiment, $T_{gon}$ is the time duration between 95% of $V_{gs,on}$ of the pixel to 5% of $V_{gs,on}$ of the pixel. In yet another embodiment, $T_{gon}$ is the time duration between 85% of $V_{gs,on}$ of the pixel to 15% of $V_{gs,on}$ of the pixel, R is the resistance of the trace, $C_p$ is the storage capacitor of the pixel, $I_{ds1}$ and $I_{ds2}$ are respectively the driving currents of the two pixels, and $T_{yd}$ is the conducting time difference between two pixels.

Figure 10:
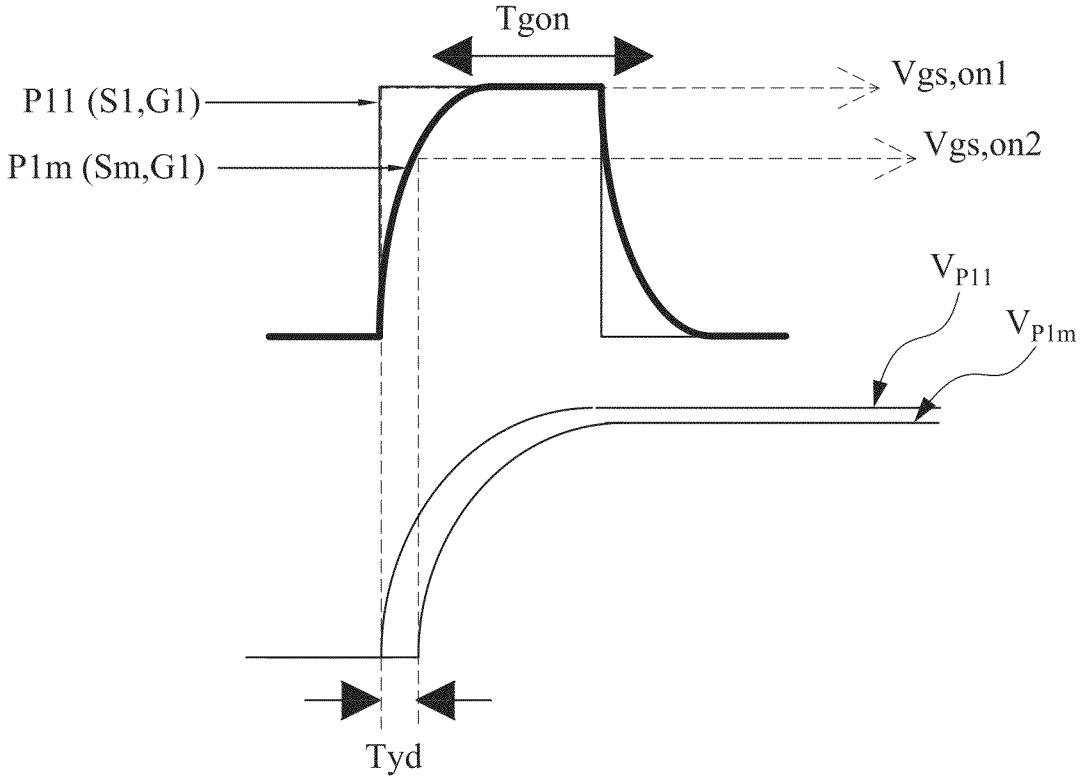
FIG. 10 is a schematic diagram illustrating a voltage signal of a pixel of a display device according to embodiments of the present invention.
Figure 11:
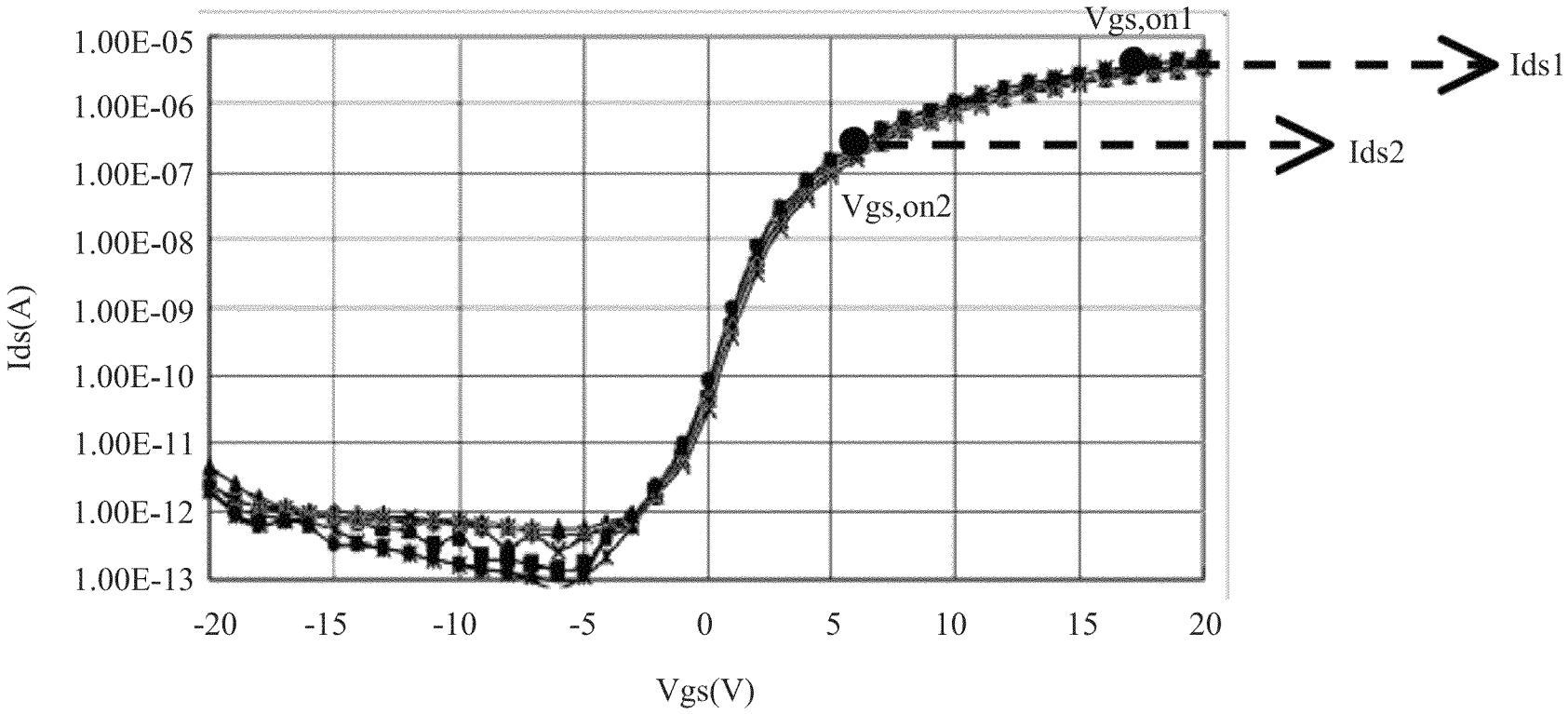
FIG. 11 is a curve-voltage curve diagram of a pixel of a display device according to embodiments of the present invention.

The above-mentioned values can be obtained by measuring the pixels, as detailed below. Reference is made to FIG. 10 and FIG. 11 which respectively illustrate the voltage signal and current-voltage curve of the pixel of a display device 100*a* according to embodiments of the present invention. Referring to FIG. 10, taking pixel P11 and P1*m* as examples, it can be seen that $T_{gon}$ is about the time duration between 90% of $V_{gs,on}$ of the pixel to 10% of $V_{gs,on}$ of the pixel, and $T_{yd}$ is the conducting time difference between two pixels. Further, referring to FIG. 11, it is seen that $V_{gs,on1}$ and $V_{gs,on2}$ of the two pixels respectively correspond to the driving currents $I_{ds1}$ and $I_{ds2}$.

Moreover, according to Equations 1, 2 and 3 above, the voltage of any pixel of the pixel array of the display device 100*a* can be calculated according to the following equation:

$$V_{pix2}=[(AVDD+\Delta V)-AVSS]e^{\frac{T_{gon}-T_{yd}}{RC_p}} \qquad \text{Equation 4}$$

Figure 12:
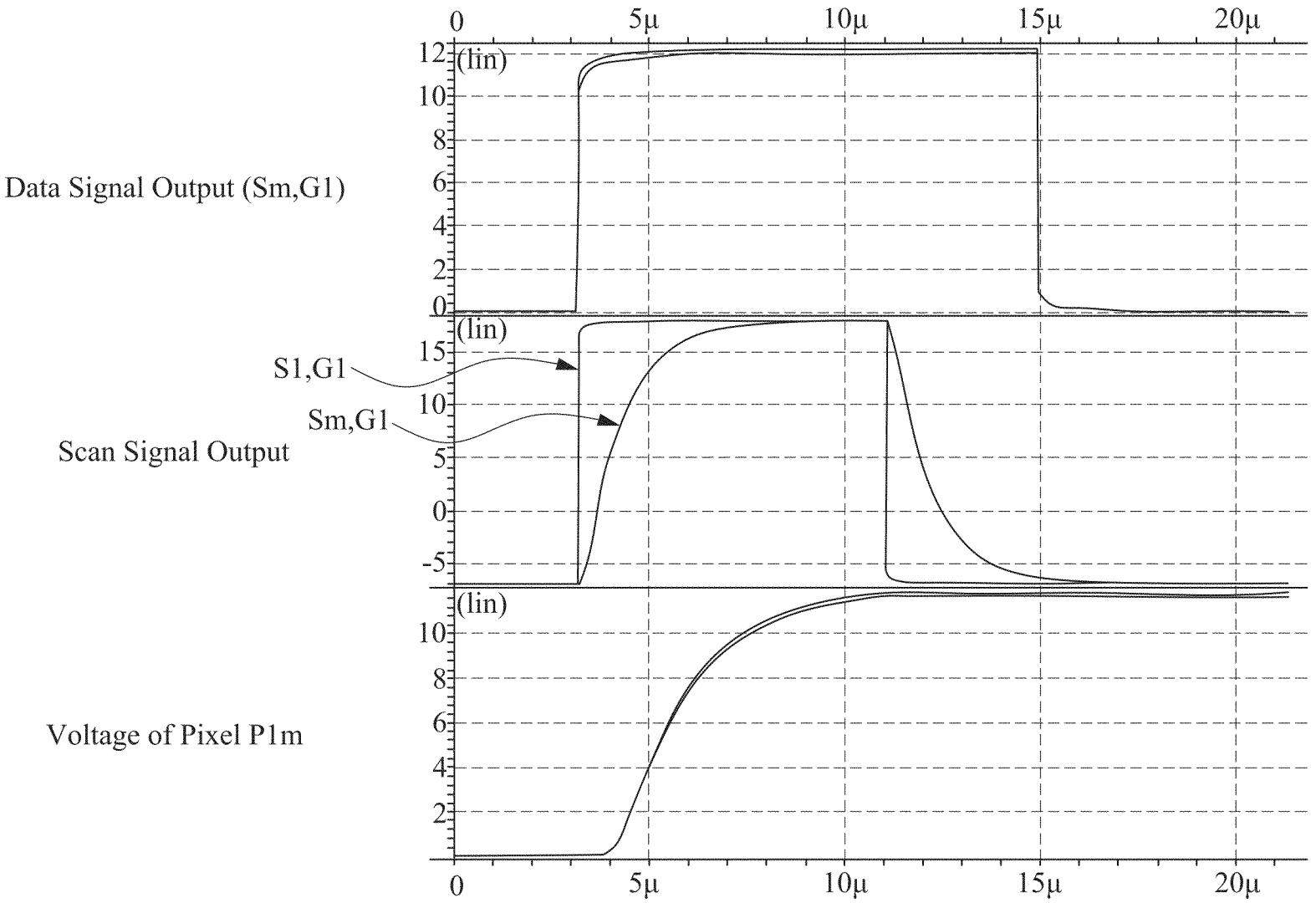
FIG. 12 is a schematic diagram illustrating a pixel voltage verification of a pixel of a display device according to embodiments of the present invention.
Figure 13:
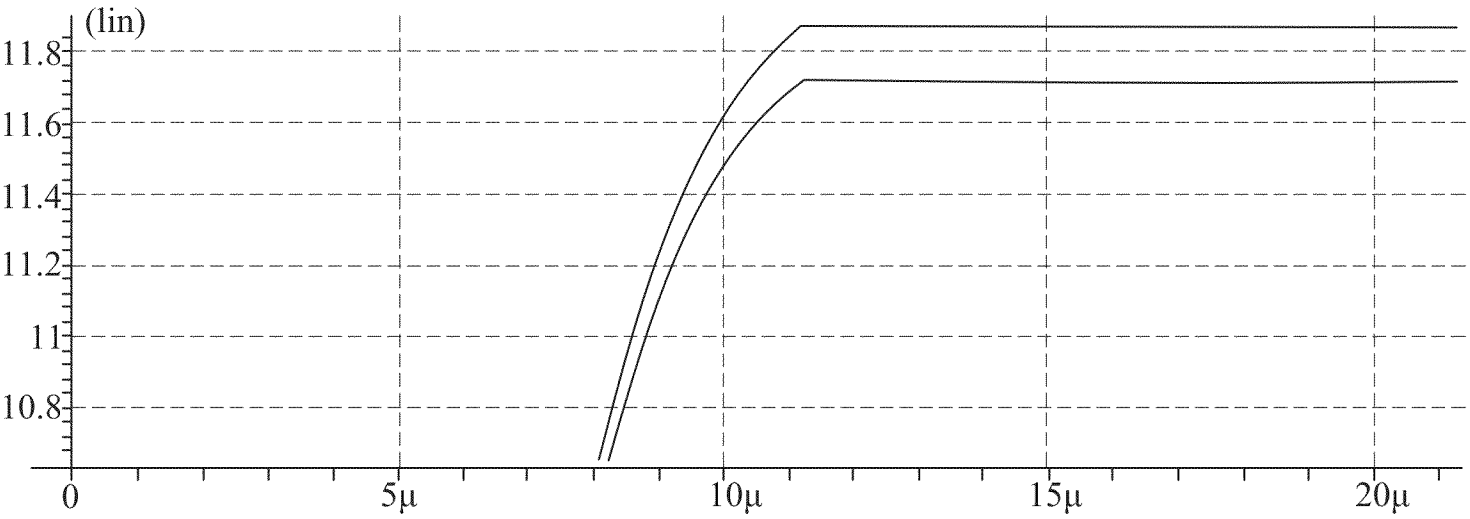
FIG. 13 is a partial enlargement drawing illustrating the pixel voltage verification of the pixel of the display device of FIG. 12 according to embodiments of the present invention.

The display device 100*a* of FIG. 7 has been tested and verified, and the results are presented in FIG. 12. As illustrated, although there is a conducting time difference or a turn-off time difference between two pixels, after using the controller 130 to control the data driver 120 to overcharge the pixel by a voltage difference according to the conducting time difference or the turn-off time difference, the charging ratio of the pixel voltage (for example, the pixel P1*m*) is increased. Specifically, referring to FIG. 13, which is a partial enlargement drawing illustrating the pixel voltage verification of the pixel of the display device of FIG. 12 according to embodiments of the present invention, it is seen that the charging ratio of the pixel voltage, post-overcharging, is increased to 99%, as compared to the 97.7% where no overcharging is performed.

In another embodiment, the present disclosure further provides a method for charging a display device. To facilitate the understanding of the embodiments of the present invention, reference is made to FIG. 1 and FIG. 2 so as to provide an exemplified discussion of the driving method of the present invention. The present driving method uses the gate driver 110 to turn on the transistor T11 of the pixel P11 of the plurality of pixels P11~Pnm for one time during the first turn-on period 1H of a plurality of turn-on cycles of frame cycle Frame(n) of a frame displayed by the display device 100. Thereafter, the present method uses the data driver 120 to charge the pixel capacitor C11 of the pixel P11 to a first over-charge voltage $V_{OD1}$ via the transistor T11 of the pixel P11 during the first turn-on period 1H. Subsequently, the present method uses the data driver 120 to charge the pixel capacitor C11 of the pixel P11 to a data voltage Vsource_n via the transistor T11 of the pixel P11 during the recovery period T1-2 of the first turn-on period 1H. Here, the first over-charge voltage $V_{OD1}$ may be greater than the data voltage Vsource_n; however, in other embodiments, the first over-charge voltage $V_{OD1}$ may also be less than the data voltage Vsource_n.

In summary, the pixel capacitor C11 of the pixel P11 should be charged to the data voltage Vsource_n; however, since the resolution of the liquid crystal panel of the display device 100 is increased, the time available for each gate line to be charged is shortened. This may result in the incomplete charging of the pixel capacitor C11 of the pixel P11. However, the present invention solves this problem. According to the driving method of the present invention, when the transistor T11 of the pixel P11 is turned on, a voltage greater or less than the data voltage Vsource_n is provided to the pixel capacitor C11 of the pixel P11 during the over-charge period, so that the pixel capacitor C11 of the pixel P11 can be rapidly charged to a predetermined data voltage Vsource_n. Next, the driving method of the present invention allows the voltage of the pixel capacitor C11 of the pixel P11 to return to the data voltage Vsource_n during the recovery period.

In this way, the driving method of the present invention overcomes the problem of abnormal display resulting from the incomplete charging of pixels due to the increased number of gate lines and increased loading of the active area of the liquid crystal display panel.

In one embodiment, referring to both FIG. 1 and FIG. 3, the driving method of the present invention further uses the gate driver 110 to turn on the transistor T21 of the pixel P21 of the plurality of pixels P11~Pnm during the second turn-on period 2H of the frame cycle Frame(n). Next, the present method uses the data driver 120 during the over-charge period T2-1 of the second turn-on period 2H to charge the pixel capacitor C21 of the pixel P21 to the second over-charge voltage $V_{OD2}$ via the transistor T21 of the pixel P21. Thereafter, the present method uses the data driver 120 during the recovery period T2-2 of the second turn-on period 2H to charge the pixel capacitor C21 of the pixel P21 to the data voltage Vsource_n via the transistor T21 of the pixel P21, wherein one of the first over-charge voltage $V_{OD1}$ and the second over-charge voltage $V_{OD2}$ is greater than the data voltage Vsource_n, and the other of the first over-charge voltage $V_{OD1}$ and the second over-charge voltage $V_{OD2}$ is less than the data voltage Vsource_n.

In still another embodiment, the driving method of the present invention further uses the comparator to compare the data voltage Vsource_n of the frame cycle Frame(n) and the previous data voltage Vsource_n−1 of the previous frame cycle Frame(n−1). When the data voltage Vsource_n is greater than the previous data voltage Vsource_n−1, it is determined that the first over-charge voltage $V_{OD1}$ is greater than the data voltage Vsource_n. In contrast, when the data voltage Vsource_n is less than the previous data voltage Vsource_n−1, it is determined that the first over-charge voltage $V_{OD1}$ is less than the data voltage Vsource_n. Moreover, the logic for determining the second over-charge voltage $V_{OD2}$ and the third over-charge voltage $V_{OD3}$ is similar to that for determining the first over-charge voltage $V_{OD1}$, and hence a detailed description thereof is omitted herein for the sake of brevity.

In an optional embodiment, referring to FIG. 4 and FIG. 5, the driving method of the present invention further uses the gate driver 410 to turn on the transistor T21 of the pixel P21 via the second scan line Line2 during the second turn-on period 2H of the plurality of turn-on cycles of the frame cycle Frame(n) of the frame displayed by the display device 400. Next, the present method uses the data driver 420 to charge the pixel capacitor C21 of the pixel P21 to a first over-charge voltage $V_{OD1}$ via the transistor T21 of the pixel P21 during the over-charge period T1-1 of the first control period T of the second turn-on period 2H. Further, the present method uses the data driver 420 to charge the pixel capacitor C21 of the pixel P21 to another data voltage Vsource_n+1 via the transistor T21 of the pixel P21 during the recovery period T1-2 of the first control period T1 of the second turn-on period 2H. Here, the first over-charge voltage $V_{OD1}$ may be less than said another data voltage Vsource_n+1; however in other embodiments, the first over-charge voltage $V_{OD1}$ may also be greater than the another data voltage Vsource_n+1.

In one embodiment, referring to FIG. 4 and FIG. 5, the driving method of the present invention further uses the gate driver 110 to turn on the first switch M1 during the first control period T1 of the second turn-on period 2H of the frame cycle Frame(n), turns on the second switch M2 during the second control period T2 of the second turn-on period 2H of the frame cycle Frame(n), and turns on the third switch M3 during the third control period T3 of the second turn-on period 2H of the frame cycle Frame(n). Next, the present method uses the data driver 420 to charge the pixel capacitor C21 of the pixel P21 to the first over-charge voltage $V_{OD1}$ via the first switch M1 during the over-charge period T1-1 of the first control period T1 of the second turn-on period 2H. Further, the present method uses the data driver 420 to charge the pixel capacitor C22 of the pixel P22 to the second over-charge voltage $V_{OD2}$ via the second switch M2 during the over-charge period T2-1 of the second control period T2 of the second turn-on period 2H, and to charge the pixel capacitor C23 of the pixel P23 to the third over-charge voltage $V_{OD3}$ via the third switch M3 during the over-charge period T3-1 of the third control period T3 of the second turn-on period 2H. As illustrated, the first over-charge voltage $V_{OD1}$ is less than the another data voltage Vsource_n+1, the second over-charge voltage $V_{OD2}$ is greater than the data voltage Vsource_n+1, and the third over-charge voltage $V_{OD3}$ is greater than the data voltage Vsource_n+1; however, the present invention is not limited thereto, and persons having ordinary skill in the art can selectively arrange the over-charge voltage depending on actual needs.

In another embodiment, referring to FIG. 4 and FIG. 5, the driving method of the present invention further uses the comparator to compare the another data voltage Vsource_n+1 and the data voltage Vsource_n. When the another data voltage Vsource_n+1 is greater than the data voltage Vsource_n, it is determined that the first over-charge voltage $V_{OD1}$ is greater than the another data voltage Vsource_n+1. On the other hand, when the another data voltage Vsource_n+1 is less than the data voltage Vsource_n, it is determined that the first over-charge voltage $V_{OD1}$ is less than the another data voltage Vsource_n+1. Moreover, the logic for determining the second over-charge voltage $V_{OD2}$ and the third over-charge voltage $V_{OD3}$ is similar to that for determining the first over-charge voltage $V_{OD1}$, and hence a detailed description thereof is omitted herein for the sake of brevity.

In another embodiment, the present invention further provides a method for driving a display device. To facilitate the understanding of the embodiments of the present invention, reference will be made to FIG. 7 so as to provide an exemplified discussion of the driving method of the present invention. The driving method of the present invention uses the controller 130 to generate and output the control signal to the data driver 120 according to voltage signals of any two pixels of the pixel array, and then uses the data driver 120 to adjust the first difference ΔV1, the second difference ΔV2 or the third difference ΔV3 shown in FIG. 2 according to the control signal.

In one embodiment, more specifically, the driving method of the present invention uses the controller 130 to generate and output the control signal according to the first voltage signal of the pixel P11 at the first row and the first column of the pixel array and the second voltage signal of the pixel P1*m* at the first row and the $M^{th}$ column of the pixel array. In another embodiment, the driving method of the present invention uses the controller 130 to generate and output the control signal according to the first voltage signal of the pixel P11 at the first row and the first column of the pixel array and the second voltage signal of the pixel Pnm at the $N^{th}$ row and the $M^{th}$ column of the pixel array.

To facilitate the understanding of the embodiments of the present invention, reference will be made to FIG. 8 so as to provide an exemplified discussion of the driving method of the present invention. The driving method of the present invention uses the voltage-detection circuit 132 to detect the first voltage signal and the second voltage signal. Next, the driving method of the present invention uses the calculation circuit 134 to calculate the conducting time difference and the turn-off time difference according to the first voltage signal and the second voltage signal. The driving method of the present invention subsequently uses the timing control circuit 136 to generate and output the control signal according to the conducting time difference or the turn-off time difference, and then uses the data driver 120 to adjust the first difference ΔV1, the second difference ΔV2 or the third difference ΔV3 illustrated in FIG. 2 according to the control signal.

The above-described method for driving a display device can be implemented by software, hardware and/or firmware. For example, if an implementer determines that speed and accuracy are paramount, the implementer may opt for a mainly hardware and/or firmware implementation; if flexibility is paramount, the implementer may opt for a mainly software implementation; alternatively, the collaboration of software, hardware and firmware may be adopted. It should be noted that none of the above-mentioned examples is inherently superior to the other and shall be considered limiting to the scope of the in present invention; rather, these examples can be utilized depending upon the context in which the unit/component will be deployed and the specific concerns of the implementer.

Further, as may be appreciated by persons having ordinary skill in the art, the steps of the method for driving a display device are named according to the function they perform, and such naming is provided to facilitate the understanding of the present disclosure but not to limit the steps. Combining the step into a single step or dividing any one of the steps into multiple steps, or switching any step so as to be a part of another step falls within the scope of the embodiments of the present disclosure.

In view of the above embodiments of the present disclosure, it is apparent that the application of the present invention has a number of advantages. Embodiments of the present disclosure provide a display device and a method for driving the same to overcome the problem of abnormal display resulting from the incomplete charging of pixels due to the increased number of gate lines and increased loading of the active area of the liquid crystal display panel.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A display device, comprising:

a plurality of pixels, each of the plurality of pixels comprising a transistor and a pixel capacitor, wherein the transistor is electrically coupled to the pixel capacitor;

a gate driver configured to turn on the transistor of a first pixel of the plurality of pixels for one time during a first turn-on period of a plurality of turn-on cycles of a frame cycle of a frame displayed by the display device, wherein the gate driver is configured to turn on the transistor of a second pixel of the plurality of pixels during a second turn-on period of the frame cycle; and a data driver configured to charge the pixel capacitor of the first pixel to a first over-charge voltage via the transistor of the first pixel during an over-charge period of the first turn-on period, and charge the pixel capacitor of the first pixel to a data voltage via the transistor of the first pixel during a recovery period of the first turn-on period, wherein the data driver is configured to charge the pixel capacitor of the second pixel to a second over-charge voltage via the transistor of the second pixel during an over-charge period of the second turn-on period, and charge the pixel capacitor of the second pixel to a data voltage via the transistor of the second pixel during a recovery period of the second turn-on period, wherein one of the first over-charge voltage and the second over-charge voltage is greater than the data voltage, and the other of the first over-charge voltage and the second over-charge voltage is less than the data voltage.

2. The display device of claim 1, wherein the over-charge period of the first turn-on period and the recovery period of the first turn-on period are adjustable.

3. The display device of claim 1, wherein the first over-charge voltage and the data voltage have a first difference therebetween, and the second over-charge voltage and the data voltage have a second difference therebetween.

4. The display device of claim 3, wherein the time duration of the first difference is in direct proportion to the time duration of the recovery period of the first turn-on period, and the first difference is different from the second difference.

5. The display device of claim 3, wherein the plurality of pixels are arranged into a pixel array having M columns and N rows, and the display device further comprises:

a controller configured to generate and output a control signal to the data driver according to voltage signals of any two pixels of the pixel array, and the data driver is configured to adjust the first difference or the second difference according to the control signal.

6. The display device of claim 5, wherein the controller is further configured to generate and output the control signal to the data driver according to a first voltage signal of the pixel at the first row and the first column of the pixel array and a second voltage signal of the pixel at the first row and the $M^{th}$ column of the pixel array.

7. The display device of claim 6, wherein the controller comprises:

a voltage-detection circuit configured to detect the first voltage signal and the second voltage signal;

a calculation circuit configured to calculate a conducting time difference and a turn-off time difference according to the first voltage signal and the second voltage signal; and a timing control circuit configured to generate and output the control signal to the data driver according to the conducting time difference or the turn-off time difference.

8. The display device of claim 5, wherein the controller is configured to generate and output the control signal to the data driver according to a first voltage signal of the pixel at the first row and the first column of the pixel array and a second voltage signal of the pixel at the $N^{th}$ row and $M^{th}$ column of the pixel array.

9. The display device of claim 8, wherein the controller comprises:

a voltage-detection circuit configured to detect the first voltage signal and the second voltage signal;

a calculation circuit configured to calculate a conducting time difference and a turn-off time difference according to the first voltage signal and the second voltage signal; and a timing control circuit configured to generate and output the control signal to the data driver according to the conducting time difference or the turn-off time difference.

10. The display device of claim 1, wherein the over-charge period of the first turn-on period is different from the over-charge period of the second turn-on period.

11. The display device of claim 1, wherein a value of the first over-charge voltage is determined according to a previous data voltage of the pixel capacitor of the first pixel during a recovery period of a first turn-on period of a previous frame cycle.

12. The display device of claim 1, further comprising:

a comparator configured to compare the data voltage of the frame cycle and a previous data voltage of a previous frame cycle, wherein when the data voltage is greater than the previous data voltage, the comparator determines that the first over-charge voltage is greater than the data voltage, and when the data voltage is less than the previous data voltage, the comparator determines that the first over-charge voltage is less than the data voltage.

13. The display device of claim 1, further comprising:

a first scan line electrically coupled to the first pixel; and a second scan line electrically coupled to a second pixel of the plurality of pixels, wherein the first scan line and the second scan line are arranged sequentially;

wherein the gate driver is configured to turn on the transistor of the second pixel via the second scan line for one time during a second turn-on period of the plurality of turn-on cycles of the frame cycle of a frame displayed by the display device; and wherein the data driver is configured to charge the pixel capacitor of the second pixel to a second over-charge voltage via the transistor of the second pixel during an over-charge period of a first control period of the second turn-on period, and charge the pixel capacitor of the second pixel to another data voltage via the transistor of the second pixel during a recovery period of the first control period of the second turn-on period, wherein the second over-charge voltage is greater or less than the another data voltage.

14. The display device of claim 13, wherein the over-charge period of the first control period and the recovery period of the first control period are adjustable.

15. The display device of claim 13, wherein the data driver comprises:

a first switch electrically coupled to the second pixel; and a second switch electrically coupled to a third pixel, wherein the third pixel is electrically coupled to the second scan line;

wherein the gate driver is configured to turn on the first switch during the first control period of the second turn-on period of the frame cycle, and turn on the second switch during a second control period of the second turn-on period of the frame cycle; and wherein the data driver is configured to charge the pixel capacitor of the second pixel to the second over-charge voltage via the first switch during the over-charge period of the first control period of the second turn-on period, wherein the data driver is configured to charge the pixel capacitor of the third pixel to a third over-charge voltage via the second switch during an over-charge period of the second control period of the second turn-on period;

wherein one of the second over-charge voltage and the third over-charge voltage is greater than the another data voltage, and the other of the second over-charge voltage and the third over-charge voltage is less than the data voltage.

16. The display device of claim 15, wherein the second over-charge voltage and the another data voltage have a first difference therebetween, and the time duration of the first difference is in direct proportion to the time duration of the recovery period of the first control period.

17. The display device of claim 16, wherein the third over-charge voltage and the another data voltage have a second difference therebetween, wherein the first difference is different from the second difference.

18. The display device of claim 15, wherein the over-charge period of the first control period is different from the over-charge period of the second control period.

19. The display device of claim 13, wherein a value of the second over-charge voltage is determined according to the data voltage of the first pixel electrically coupled to the first scan line.

20. The display device of claim 13, further comprising:

a comparator configured to compare the another data voltage and the data voltage, wherein when the another data voltage is greater than the data voltage, the comparator determines that the second over-charge voltage is greater than the another data voltage, and when the another data voltage is less than the data voltage, the comparator determines that the second over-charge voltage is less than the another data voltage.

21. A method for driving a display device, the display device comprising a plurality of pixels, each of the plurality of pixels comprising a transistor and a pixel capacitor, wherein the transistor is electrically coupled to the pixel capacitor, wherein the method comprises:

turning on the transistor of a first pixel of the plurality of pixels for one time during a first turn-on period of a plurality of turn-on cycles of a frame cycle of a frame displayed by the display device;

charging the pixel capacitor of the first pixel to a first over-charge voltage via the transistor of the first pixel during an over-charge period of the first turn-on period;

charging the pixel capacitor of the first pixel to a data voltage via the transistor of the first pixel during a recovery period of the first turn-on period;

turning on the transistor of a second pixel of the plurality of pixels during a second turn-on period of the frame cycle;

charging the pixel capacitor of the second pixel to a second over-charge voltage via the transistor of the second pixel during an over-charge period of the second turn-on period; and charging the pixel capacitor of the second pixel to the data voltage via the transistor of the second pixel during a recovery period of the second turn-on period, wherein one of the first over-charge voltage and the second over-charge voltage is greater than the data voltage, and the other of the first over-charge voltage and the second over-charge voltage is less than the data voltage.

22. The method of claim 21, wherein the plurality of pixels are arranged into a pixel array having M columns and N rows, the first over-charge voltage and the data voltage have a first difference therebetween, and the second over-charge voltage and the data voltage have a second difference therebetween, wherein the method for driving the display device comprises:

generating and outputting a control signal according to voltage signals of any two pixels of the pixel array, and adjusting the first difference or the second difference according to the control signal.

23. The method of claim 22, wherein generating and outputting a control signal according to voltage signals of any two pixels of the pixel array comprises:

generating and outputting the control signal according to a first voltage signal of the pixel at the first row and the first column of the pixel array and a second voltage signal of the pixel at the first row and the $M^{th}$ column of the pixel array.

24. The method of claim 23, wherein generating and outputting the control signal according to the first voltage signal of the pixel at the first row and the first column of the pixel array and the second voltage signal of the pixel at the first row and the $M^{th}$ column of the pixel array comprises:

detecting the first voltage signal and the second voltage signal;

calculating a conducting time difference and a turn-off time difference according to the first voltage signal and the second voltage signal; and generating and outputting the control signal according to the conducting time difference or the turn-off time difference.

25. The method of claim 22, wherein generating and outputting a control signal according to voltage signals of any two pixels of the pixel array comprises:

generating and outputting the control signal according to a first voltage signal of the pixel at the first row and the first column of the pixel array and a second voltage signal of the pixel at the $N^{th}$ row and $M^{th}$ column of the pixel array.

26. The method of claim 25, wherein generating and outputting the control signal according to the first voltage signal of the pixel at the first row and the first column of the pixel array and the second voltage signal of the pixel at the $N^{th}$ row and $M^{th}$ column of the pixel array comprises:

detecting the first voltage signal and the second voltage signal;

calculating a conducting time difference and a turn-off time difference according to the first voltage signal and the second voltage signal; and generating and outputting the control signal according to the conducting time difference or the turn-off time difference.

27. The method of claim 21, further comprising:

comparing the data voltage of the frame cycle and a previous data voltage of a previous frame cycle;

determining that the first over-charge voltage is greater than the data voltage when the data voltage is greater than the previous data voltage; and determining that the first over-charge voltage is less than the data voltage when the data voltage is less than the previous data voltage.

28. The method of claim 21, wherein the display device further comprises a first scan line and a second scan line, wherein the first scan line is electrically coupled to the first pixel, and the second scan line is electrically coupled to a second pixel, wherein the method for driving the display device further comprises:

turning on the transistor of the second pixel for one time during a second turn-on period of the plurality of turn-on cycles of the frame cycle of a frame displayed by the display device;

charging the pixel capacitor of the second pixel to a second over-charge voltage via the transistor of the second pixel during an over-charge period of a first control period of the second turn-on period; and charging the pixel capacitor of the second pixel to another data voltage via the transistor of the second pixel during a recovery period of the first control period of the second turn-on period, wherein the second over-charge voltage is greater or less than the another data voltage.

29. The method of claim 28, wherein the display device further comprises a first switch and a second switch, wherein the first switch is electrically coupled to the second pixel, and the second switch is electrically coupled to a third pixel, wherein the method for driving the display device further comprises:

turning on the first switch during the first control period of the second turn-on period of the frame cycle, and turning on the second switch during a second control period of the second turn-on period of the frame cycle;

charging the pixel capacitor of the second pixel to the second over-charge voltage via the first switch during an over-charge period of the first control period of the second turn-on period; and charging the pixel capacitor of the third pixel to a third over-charge voltage via the second switch during an over-charge period of the second control period of the second turn-on period, wherein one of the second over-charge voltage and the third over-charge voltage is greater than the another data voltage, and the other of the second over-charge voltage and the third over-charge voltage is less than the data voltage.

30. The method of claim 28, further comprising:

comparing the another data voltage and the data voltage;

determining that the second over-charge voltage is greater than the another data voltage when the another data voltage is greater than the data voltage; and determining that the second over-charge voltage is less than the another data voltage when the another data voltage is less than the data voltage.

* * * * *